US005979371A

United States Patent [19]

Lewis

[11] Patent Number: 5,979,371

[45] Date of Patent: Nov. 9, 1999

[54] FOAM DISTRIBUTION JACKET AND METHOD OF INSULATING A HOT WATER HEATER WITH EXPANDABLE FOAM MATERIAL

[75] Inventor: Brian M. Lewis, Lachine, Canada

[73] Assignee: Giant Factories Inc., Montreal, Canada

[21] Appl. No.: 08/966,408

[22] Filed: Nov. 7, 1997

Related U.S. Application Data

[63] Continuation-in-part of application No. 08/767,274, Dec. 16, 1996.

[51] Int. Cl.[6] ..... F22B 37/36

[52] U.S. Cl. ..... 122/494; 122/13.1; 264/46.9; 126/361; 126/344

[58] Field of Search ..... 122/13.1, 494; 264/46.9, 46.6; 126/344, 361, 350 R

[56] References Cited

U.S. PATENT DOCUMENTS 4,861,968 8/1989 West ..... 392/449
5,711,256 1/1998 Brandon ..... 122/13.1

*Primary Examiner*—Teresa Walberg
*Assistant Examiner*—Jiping Lu
*Attorney, Agent, or Firm*—Guy Houle; Swabey, Ogilvy, and Renault

[57] ABSTRACT

A foam distribution jacket (10) for containing an insulating expandable liquid foam mixture (44) prior to expansion into a space (17) between a hot water tank (22) and an outer casing (29) secured thereabout. The jacket (10) comprises a pair of sheets (11–12) which are superimposed to define a bottom trough section (13) having a straight bottom edge (15) and opposed end edges (16). A seal (17) is formed along the straight bottom edge and the opposed end edges to form the trough (13) and to interconnect the sheets (11–12). The pair of sheets (11–12) converge to a crest portion (19) at a top end section (14) thereof. An attachment hole (20) is provided in the crest of an inner one of the pair of sheets (11–12) and is adapted to attach the jacket (10) in a depending manner from a nipple (21) in a top wall (48) of a hot water tank (22). The method of insulating a surrounding space (27) formed between the hot water tank (22) and the outer casing (29) using the foam distribution jacket (10) is also described.

10 Claims, 3 Drawing Sheets

FOAM DISTRIBUTION JACKET AND METHOD OF INSULATING A HOT WATER HEATER WITH EXPANDABLE FOAM MATERIAL

CROSS-REFERENCE TO RELATED APPLICATION

This application is a C-I-P of patent application Ser. No. 08/767,274, filed on Dec. 16, 1996.

TECHNICAL FIELD

The present invention relates to a foam distribution jacket for a hot water heater whereby to contain an insulating expandable liquid foam mixture prior to expansion and to facilitate recycling the tank, as well as to the method of insulating the surrounding space formed between an inner hot water tank and an outer casing of the hot water heater with the use of the distribution jacket.

BACKGROUND ART

There are several advantages in using rigid foam insulation in water heater construction and many of these are described in, for example, U.S. Pat. No. 4,861,968 issued on Aug. 29, 1989. It is also advantageous to use expanding foam material that can flow freely within the circumferential space provided within the hot water tank and the outer casing thereof. Foam material, when in its liquid state, is introduced into this space, usually in an envelope or a bag whereby to prevent the foam from attaching itself to the hot water tank, the various controls and pipes therein and the outer wall of the inner casing or the hot water heater. A disadvantage of using bags and envelopes is that it makes it difficult for the foam material to penetrate into small areas and around nipples, controls, and other types of fittings.

In the above-referenced patent there is described an envelope which is formed of opposed sheets of plastic material which is wrapped around the hot water tank surface and wherein predetermined sealed holes are provided in the envelope with the seal formed thereabout whereby to receive therethrough the various components which are secured to the hot water tank and which need to be maintained uncovered or protected from the foam material. Such envelope is therefore time-consuming to install, particularly if the holes are not accurately positioned within the envelope due to an installation error where the top of the envelope may be inverted. Furthermore, with this type of envelope it is difficult to maintain it in position about the hot water tank, as the outer casing is brought down over the outer flexible sheet of the envelope due to the size of the outer sheet which is held loose over the hot water tank. It then becomes time-consuming to readjust the envelope from the open top end of the outer casing and bring the outer sheet over a major section of the outer casing to clamp it with the cover. A still further disadvantage is that these envelopes have to be adapted to specific ones of different types of water heaters where fittings and controls are positioned at different locations and where the inner tank is of different size.

There also exists a need to provide a jacket to contain a liquid foam prior to expansion and distribute the foam in a predetermined controlled manner and wherein the jacket may be adapted to a variety of hot water heaters regardless of the position of couplings, controls or other devices. There is also a need to provide a method of assembly of the jacket on the hot water tank which is simple, efficient and wherein there are no apertures in the jacket to fit around existing controls or other components secured to the hot water tank. There is also a need to provide an insulated hot water heater which is easy to recycle after its useful life.

The majority of water heaters/storage tanks, are currently insulated with foams that use chlorofluorocarbons, normally referred to as CFC's, as blowing agents, for instance, CFC-11 (trichlorofluoromethane) and CFC-12 (dichlorodifluoromethane). These blowing agents have been implicated in the deterioration of the stratospheric ozone layer. A replacement blowing agent known as HCFC's (hydrochlorofluorocarbon's) is currently being used and this agent has been linked to an increase in the global greenhouse effect.

The present invention provides an environmental-friendly water heater which uses 'Green Foam' (trade name of Giant Factories) which uses a non-chlorofluorocarbon blowing agent, in this instance, water as a blowing agent. In particular, the intended foam to be used is described in U.S. Pat. No. 5,407,967 assigned to the Stepan Company. This foam is dispensed into an EMB PU-0 machine, and into the water heaters/storage tank circumferential cavities, using a Hi-Tech Mix-head of a straight or L design, (the L head is used when reduced velocity is required). The advantage of using 'Green Foam' over the types previously mentioned, is that when the time comes to dispose of the unit at the end of its useful life, the current methods are to dispose of them in an intact condition into overburdened dump sites, or the units are shredded to recycle the raw materials. These procedures create serious problems, as both methods cause the CFC's to be released to the atmosphere, the first gradually, the second instantly. 'Green Foam' does not create any of these problems, as any gas released is in the form of carbon dioxide which is what we breath out every time we exhale. It is the intention of the foam insulated water heater of the present invention to allow full re-cycling of all the components used in the manufacturing process.

SUMMARY OF INVENTION

Full recycling is achieved by coating the bare metal surfaces with a release agent, to allow easy removal of the foam, (currently very difficult to remove). This allows for recycling of the outer case into new steel. The inner tank (water container) can then be refurbished for re-use in a new water heater. This would include welding by laser and re-glass lining where necessary, to allow a new warranty to be issued. Foam products can also be re-cycled after grinding and used in many areas, in particular furniture, soil aeration, etc. Plastic components where serviceable, can be re-used or re-ground and used as filler material. The foam distribution jacket can be re-used where plastic sheeting is the material of choice. Where paper or similar material is used to make the jacket, it will be biodegradable. Thus, the bulk of the materials used in the original manufacturing process, can be re-cycled into useful products, which in turn, reduces the drain on natural resources.

Another feature of the present invention is to provide a foam distribution jacket which uses less plastic material than many of the prior art wrappers and which is easy to install and which by the nature of its construction permits the foam to expand in a controlled manner within a circumferential space between the hot water heater and the outer casing thereof. Any controls or other type components that need to be isolated from the foam are protected by insulating material and disposed in sealed holes provided in the jacket.

The present invention also provides a novel method of insulating the surrounding space formed between a hot water tank and an outer casing of a hot water heater.

According to the above features of the present invention, from one of its broad aspects, it provides a foam distribution jacket to contain an insulating expandable foam liquid mixture for expansion in a space between a hot water tank and an outer casing secured thereabout. The jacket comprises a pair of sheets of suitable material superimposed to define a bottom trough section having a straight bottom edge, a sealed lower side edge and an opposed open lower side edge. A seal is formed along the straight bottom edge and one of the opposed lower side edges to form the bottom trough and interconnect the sheets. The pair of sheets converge to a crest portion at a top end thereof. An attachment means is provided in the crest of at least an inner one of the pair of sheets and is adapted to attach the jacket in a depending manner from a nipple in a top wall of a hot water tank.

According to a further broad aspect of the present invention there is provided the foam distribution jacket of the present invention, as above described, in combination with a hot water tank.

According to a still further broad aspect of the present invention there is provided a method of insulating a surrounding space formed between a hot water tank and an outer casing of a hot water heater. The method comprises attaching a foam distribution jacket in a depending manner from a nipple provided in a top wall of the hot water tank. The foam distribution jacket has a pair of sheets of suitable material superimposed and connected to define a bottom trough section having a straight bottom edge, a sealed lower side edge and an opposed end edge. A seal is formed along the straight bottom edge and one of the opposed lower side edges. The pair of sheets converge to a crest portion at a top end thereof. The bottom trough section of the jacket is positioned about a lower section of the tank. A circumferential sidewall of the outer casing is then disposed about the hot water tank. A lip of the crest portion of an outer one of the pair of sheets is clamped between the circumferential sidewall and a casing cover. An expandable insulating foam liquid material is then introduced under pressure through a hole in the casing and between the pair of sheets substantially between the crest portions of the pair of sheets whereby the foam insulating liquid material will propagate to the bottom trough where the foam will then expand and separate the pair of sheets and substantially fill the surrounding space between the hot water tank and the outer casing.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
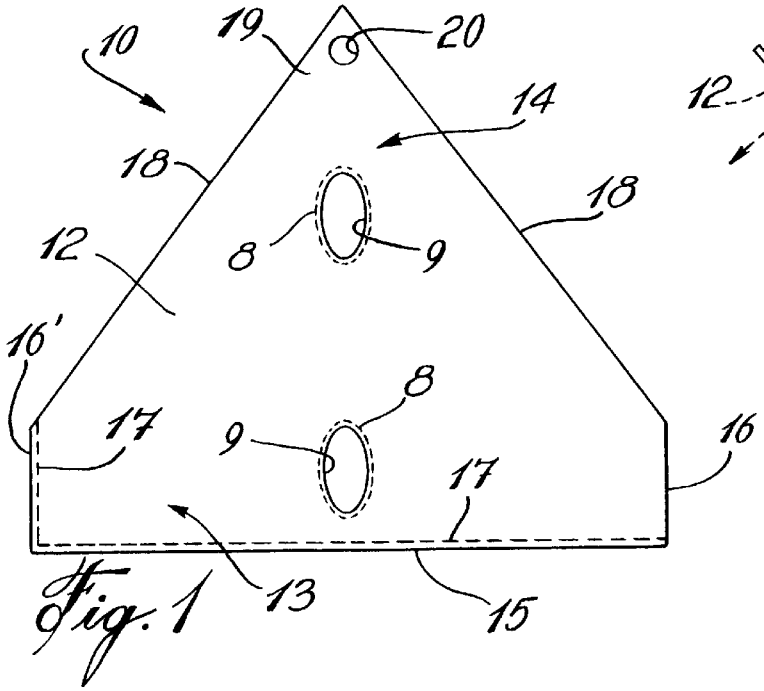
FIG. 1 is a plan view of the foam distribution jacket of the present invention.
Figure 2:
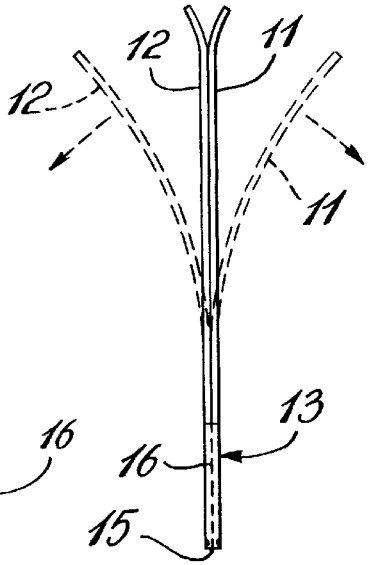
FIG. 2 is a side view of the foam distribution jacket as shown in FIG. 1 and also illustrating how the pair of sheet material separates.

Referring now to the drawings and more particularly to FIGS. 1 and 2, there is shown generally at 10 the foam distribution jacket of the present invention. As hereinshown the jacket is formed from a pair of sheets, herein an outer sheet 11 and an inner sheet 12 which are superimposed and define a bottom trough section 13 open at one end 16 and an upper section 14. The bottom trough section has a straight bottom edge 15 and opposed transverse end edges 16 and 16'. A seal 17 is formed along the straight bottom edge 15 and the transverse end edge 16' whereby to form a trough section 13 with an open end. The sheets 11 and 12 may be formed of plastic material, cardboard or other suitable materials. The length of the bottom section is sufficient to permit a portion of the sealed end 16' to be positioned inside the open end 16 when wrapped about a lower portion of a water tank 22 as shown in FIG. 3.

The pair of sheets 11 and 12 in the upper section have a triangular-like shape whereby to define angulated side edges 18 which converge to a crest portion 19 at a top end thereof.

As shown in FIG. 1, the inner sheet 12 is provided with an aperture 20, herein a circular hole, in the crest portion 19 thereof. This aperture 20 is dimensioned to receive the nipple 21 in the top wall 48 of a hot water tank 22, as shown in FIG. 3. The outer sheet 11 may also have an aperture 20 formed in its crest portion, although this is not necessary, as will be described later.

Figure 3:
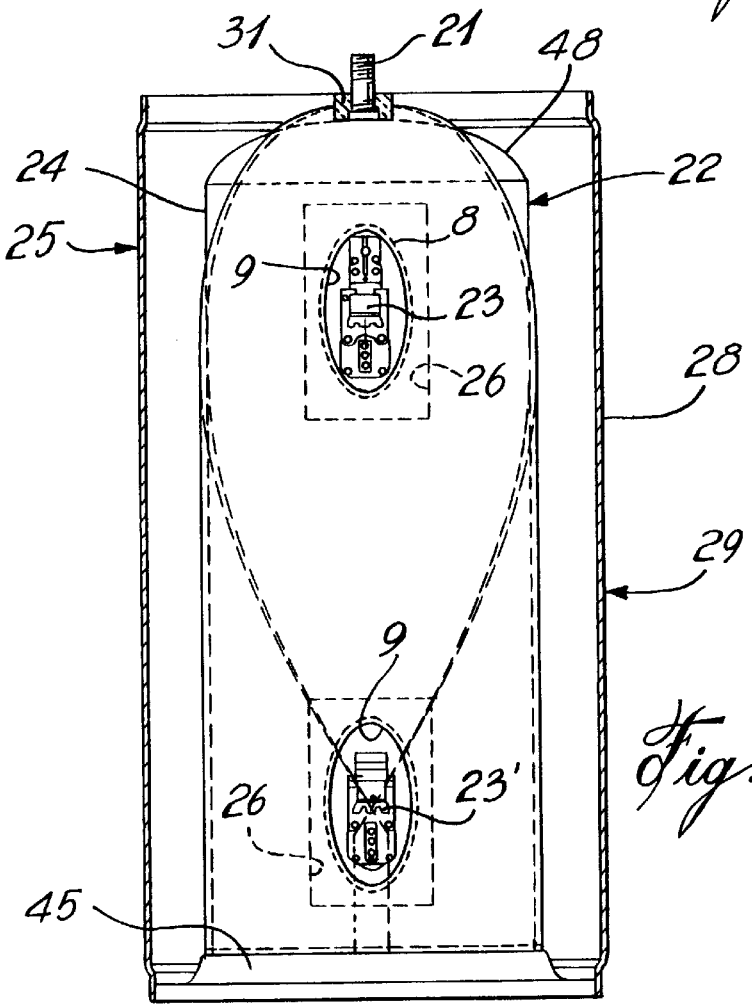
FIG. 3 is a simplified schematic view showing how the foam distribution jacket is secured about the inner tank of a hot water heater with controls secured to the hot water tank being insulated by insulating material.

The sheets 11 and 12 are also bonded to one another about apertures 9 which are adapted to receive respective component parts 23 therethrough, when fitted over a water tank 22 as shown in FIG. 3. A seal 8 is formed about these apertures 9 to prevent foam from propagating to these component parts 23.

The purpose of the jacket is two-fold. Firstly, it provides a containment of the liquid foam material prior to expansion whereby to obtain control expansion of the foam not to propagate in unwanted areas and to fill spaces where insulation is desired. Secondly, it facilitates the removal of the expanded foam during recycling of the water heater after its useful life.

Figure 4:
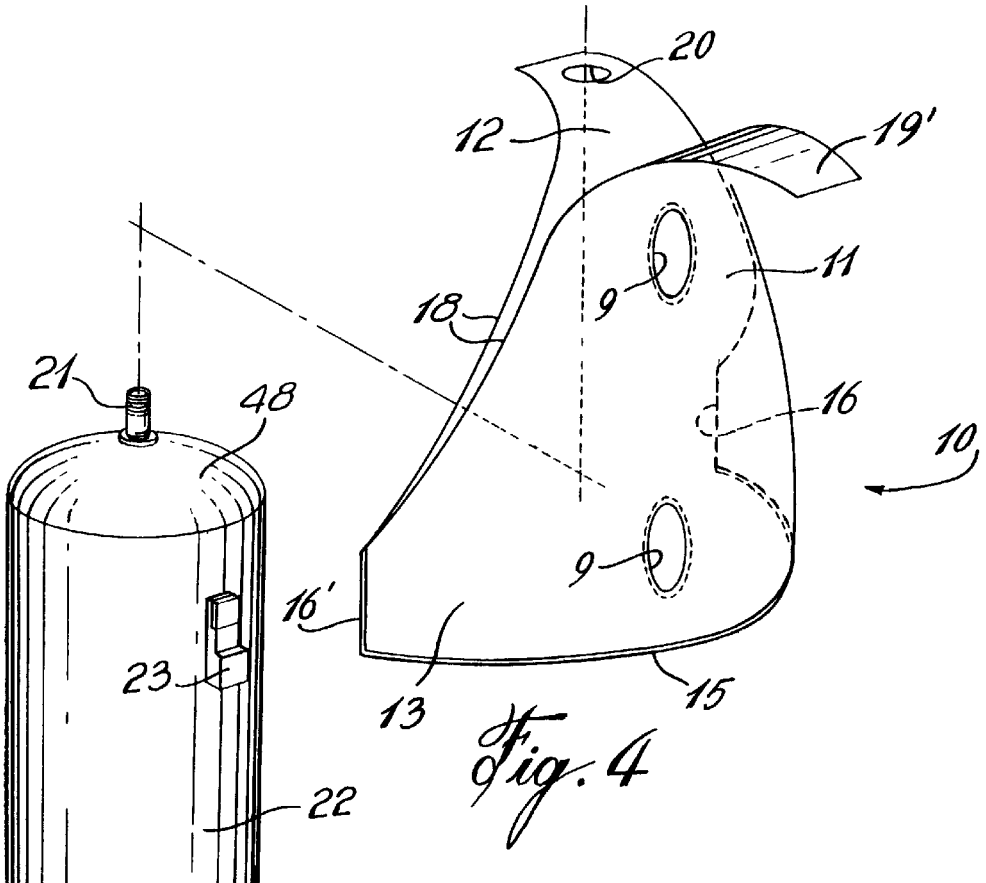
FIG. 4 is a perspective view showing how the foam distribution jacket of the present invention is attached to a hot water tank.
Figure 5:
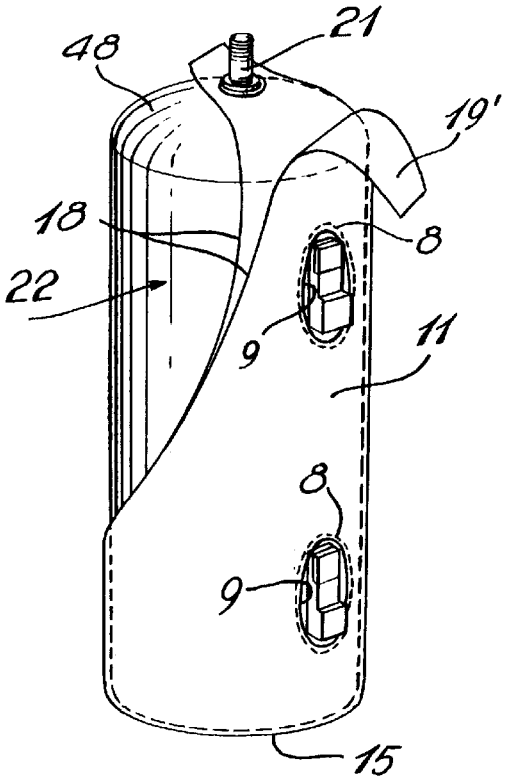
FIG. 5 is a further perspective view showing the foam distribution jacket of the present invention secured in position about a portion of the hot water tank.

Referring now to FIGS. 3 to 5, there will be described the manner in which the foam distribution jacket 10 of the present invention is attached to the hot water tank 22 of the hot water heater 25 as shown in FIG. 3. As can be seen in FIG. 3, the hot water tank 20 is provided with various component parts 23 secured to the sidewall 24 thereof. These component parts 23 may be controls or fittings to adapt an oil burner to the hot water tank, or other devices. Insulating material, such as fiberglass, wool or similar insulation, is disposed over these component parts 23 in the openings 26 and into surrounding spaces to provide good thermal insulation. The insulation about the element fitting component part 23' is preferably a mineral wool type insulation which is softer. As shown in FIG. 3, the inner tank is mounted on a rigid insulating foam base 45.

Referring now more specifically to FIGS. 4 and 5, there is shown the foam distribution jacket 10 and it is fitted onto the hot water tank in a depending manner by positioning the aperture 20 over the nipple 21 of the hot water tank 22 and aligning the apertures 9 with the component parts 23 and 23'. The bottom trough section 13 is then positioned about the bottom end portion of the hot water tank 22 and the bottom trough has a predetermined dimension wherein the open end edge 16 receives a portion of the sealed end edge 16' therein when encircled about the tank. An adhesive tape (not shown) maintains this mating relationship. Because of the shape of the jacket 10, it can be seen from FIG. 5, that once attached to the tank 22 the crest portion 19' remains on top of the tank and making it easy to retrieve after the circumferential side wall 28 is slid down over the tank 22.

As shown in FIG. 5, the jacket has an extent or a length so that the outer sheet 11 defines an attachment tongue constituted by its crest portion 19'. With the foam distribution jacket thus attached to the hot water tank 22, the circumferential side wall 28 of the outer casing can then be slid over the tank. As previously described, the tongue 19' of the outer sheet 11 may also be provided with an aperture, such as aperture 20. If this is the case, then the tongue could be temporarily held about the nipple 21 until the circumferential sidewall 28 of the outer casing 29 is slid over the hot water tank 22 and thereafter removed.

Figure 6:
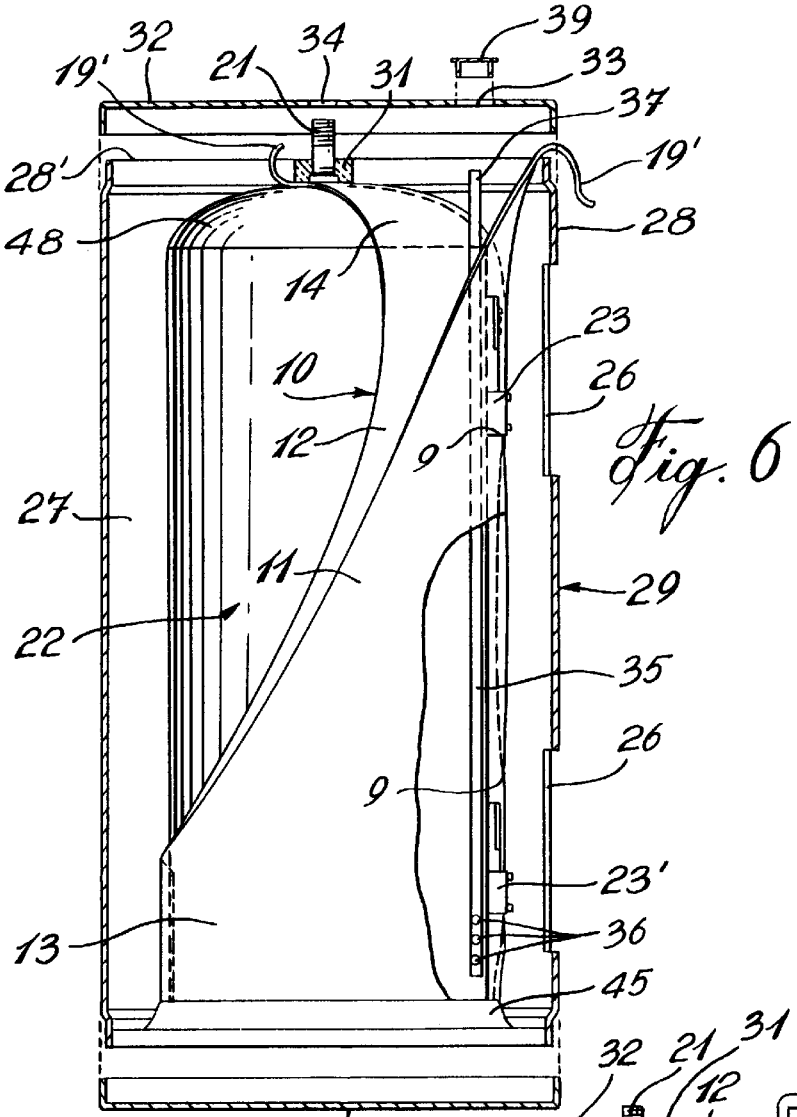
FIG. 6 is a fragmented section view showing the foam distribution jacket of the present invention secured about the hot water tank and previous to introducing the casing cover over the circumferential sidewall of the outer casing and further illustrating a drop tube disposed in position whereby to convey and release the liquid foam in a tangential manner in the bottom trough of the distribution jacket.

As shown in FIG. 6, the tank 22 is mounted on the insulating support base 45 located in a bottom pan 46 and to which the circumferential casing 28 is secured. With the circumferential casing in position about the hot water tank 22, the tongue 19' is then positioned over the top edge 28' of the circumferential side wall 28. An insulating ring 31 can then be placed over the nipple 21. A casing cover 32 is then positioned over the open top end of the circumferential side wall 28 and secured thereto with the tongue 19' held in clamping engagement over the top edge 28' of the circumferential side wall and a casing cover 32. The casing cover is provided with a hole 33 through which liquid foam insulation is introduced. The hole 33 is lined up offset from the component parts 23 and 23'. A further hole 34 is provided in the casing cover 32 to receive the central nipple 21 therethrough.

Figure 7B:
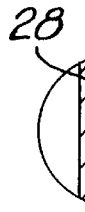
FIG. 7 is a fragmented section view illustrating another method of placing the liquid foam between the crest portions of the pair of sheet material.
Figure 7A:
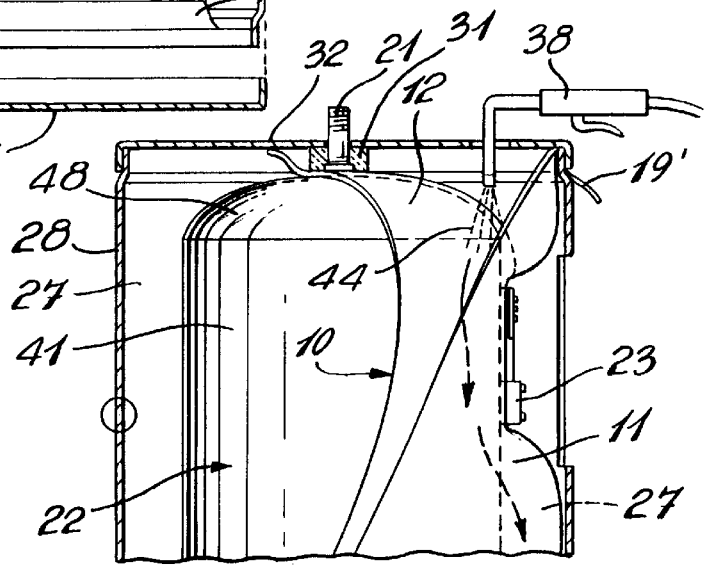

As shown in FIG. 6, a drop tube 35 may be introduced through the hole 33 and between the pair of sheets 11 and 12. The drop tube is provided with transverse holes 36 formed in a bottom section thereof. The drop tube is a straight tube having a predetermined length whereby the bottom section is located into the bottom trough section 13 of the foam distribution jacket 10. An expandable foam insulating liquid can then be introduced into the drop tube 35 from the open top end 37 thereof by means of a nozzle device 38, as shown in FIG. 7, and this liquid foam material is introduced therein under pressure whereby when it reaches the bottom of the drop tube it will disperse the liquid foam laterally through the holes 36 and on both sides of the tube so that the liquid foam is distributed along the bottom trough section 13 of the foam distribution jacket 10. The overlap of the end edges 16 and 16' of the trough ensures total circumferential coverage of the foam in the bottom end of the circumferential space 27 between the tank and the outer casing. The foam will then expand slowly from a major bottom portion of the circumferential space formed between the hot water tank 22, the circumferential sidewall 28 of the outer casing, and rise to the casing cover 32. As previously described, because the component parts 23 are surrounded by a seal 8, the foam will not propagate into the component parts 23 and 23'. The drop tube 35 may be left within the circumferential space 27 after the liquid foam is injected therein and a cap 39 then plugs the hole 33 to entrap the expanding foam material in the circumferential space 27.

As shown in FIG. 7, a nozzle device 38 can inject the liquid expanding foam material 44 directly within the jacket 10 and between the pair of sheets substantially between the crest portions thereof. Because the outer sheet has a lip 19' it is easy to align the casing cover 32 with the hole 33 in position offset from the component parts 23, 23'.

The foaming mixture utilized with the present invention is an environmental-friendly foam material which is known in the art and which contains a polyisocyanate with a polyol mixture. Details of this mixture can be obtained from U.S. Pat. No. 5,407,967.

As previously described a feature of the insulating system of the present invention is to permit the hot water heater after its useful life to be entirely recycled. In order to facilitate recycling and specifically ease of removal of the expandable foam material from the outer casing 29 as well as from the exterior exposed wall of the hot water tank, it is preferable to coat the inner surface of circumferential side wall as well as that of the casing cover with a foam release agent 40 as shown in FIG. 7. Furthermore, the exposed side wall section 41 of the tank can also be coated with this release agent. Any such release chemical as is well known in the art may be used for this coating.

It is pointed out that the present invention is not restricted to any specific type of water heater such as electric or gas fired water heaters and may also extend to storage tanks where insulation is needed to maintain the temperature of its contents insulated.

It is within the ambit of the present invention to cover any obvious modifications of the preferred embodiment described herein, provided such modifications fall within the scope of the appended claims.

I claim:

1. A foam distribution jacket to contain an insulating expandable foam liquid mixture for expansion in a space between a storage tank and an outer casing secured thereabout, said jacket comprising a pair of sheets of suitable material superimposed to define a bottom trough section having a bottom edge and opposed end edges, a seal formed along said bottom edge and one of said opposed end edges to form said trough having a sealed end edge and an open end edge, said pair of sheets converging to a crest portion at a top end thereof, and attachment means in said crest of at least an inner one of said pair of sheets and adapted to attach said jacket in a depending manner from an element in a top wall of a storage tank.

2. A foam distribution jacket as claimed in claim 1 wherein said storage tank is a hot water tank.

3. A foam distribution jacket as claimed in claim 2 wherein said trough has a predetermined length to encircle a bottom portion of a hot water tank with said sealed end edge entering an end portion of said trough through said open end edge.

4. A foam distribution jacket as claimed in claim 3 wherein said sheets are plastic film sheets.

5. A foam distribution jacket as claimed in claim 2 wherein said attachment means is an aperture formed in said crest portion of said inner one of said pair of sheets and dimensioned to receive said element therethrough, said element being a pipe section.

6. A foam distribution jacket as claimed in claim 5 wherein said jacket has an extent so that an outer one of said pair of sheets defines an attachment tongue at said crest portion which is engageable between an outer casing of a hot water tank and a top cover thereof.

7. A foam distribution jacket as claimed in claim 2 wherein said sheets are of substantially triangular outline in their extent above said bottom trough.

8. A foam distribution jacket as claimed in claim 2 wherein said sheets are fused together about one or more aperture areas thereof whereby to receive inside said aperture areas a respective component part secured to a side wall of said hot water tank and to prevent said expanding foam mixture and resulting expanded foam from propagating into said component parts.

9. A foam distribution jacket as claimed in claim 2 in combination with a hot water tank, said hot water tank being supported on an insulating base and having an outer casing secured thereabout, a space defined between said hot water tank and said outer casing, said outer casing having a top wall through which a pipe section protrudes, said nipple being connected to a top wall of said hot water tank, one or more component parts secured to a sidewall of said hot water tank, and an insulating foam material between said pair of sheets and substantially throughout said space between said hot water tank and said outer casing and said insulation material surrounding said component parts by restraining sealed apertures through which said component parts extend.

10. A foam distribution jacket and hot water tank as claimed in claim 9 wherein said outer casing has an inner surface thereof coated with a foam release material to permit ease of recycling said hot water tank.

* * * * *